US005697244A

United States Patent [19]

Seidel

[11] Patent Number: 5,697,244

[45] Date of Patent: Dec. 16, 1997

[54] METHOD AND ARRANGEMENT FOR ROLLING STRIP

[75] Inventor: Jürgen Seidel, Kreuztal, Germany

[73] Assignee: SMS Schloemann-Siemag Aktiengesellschaft, Dusseldorf, Germany

[21] Appl. No.: 406,032

[22] Filed: Mar. 17, 1995

[30] Foreign Application Priority Data

Mar. 18, 1994 [DE] Germany ..... 44 09 299.7

[51] Int. Cl.[6] ..... B21B 31/07; B21B 31/18; B21B 39/20

[52] U.S. Cl. ..... 72/247; 72/252.5

[58] Field of Search ..... 72/122, 16.5, 202, 72/247, 252.5; 492/3

[56] References Cited

U.S. PATENT DOCUMENTS

| | | | |
|---|---|---|---|
| 3,997,370 | 12/1976 | Horvath, Jr. et al. | 72/365.2 |
| 4,440,012 | 4/1984 | Feldmann et al. | 72/247 |
| 4,656,859 | 4/1987 | Ginzburg | 72/247 |
| 4,776,192 | 10/1988 | Oda et al. | 72/247 |
| 4,864,836 | 9/1989 | Ochiai | 72/247 |

FOREIGN PATENT DOCUMENTS 3919285 3/1990 Germany .

2198981 6/1988 United Kingdom .

OTHER PUBLICATIONS

Patent Abstracts of Japan, vol. 10, No. 211 (M-501) 24. Jul. 1986 & JP-A-61 052 915 (Kawasaki Steel) 15. Mar. 1986.

Patent Abstracts of Japan, vol. 18, No. 550 (M-1690) 20. Oct. 1994 & JP-A-06 198 313 (Kawasaki Steel) 19. Jul. 1994.

Patent Abstracts of Japan, vol. 8, No. 61 (M-284) 23. Mar. 1984 & JP-A-58212 802 (Kawasaki Seitetsu) 10. Dec. 1983.

*Primary Examiner*—Lowell A. Larson
*Assistant Examiner*—Rodney Butler
*Attorney, Agent, or Firm*—Friedrich Kueffner

[57] ABSTRACT

A method and an arrangement for rolling strip with axially displaceable rolls, particularly wear-resistant rolls. Rolls with increased diameter end portions are used. The rolls are axially displaced relative to each other in such a way that the rolled strip is in contact over the width thereof with the portions of the rolls having the smaller diameter. With increasing temperature of the rolls and, thus, thermal cambering of the rolls, the rolls are displaced in opposite direction relative to each other until areas of the increased diameter end portions are moved over edge areas of the rolled strip.

8 Claims, 1 Drawing Sheet

METHOD AND ARRANGEMENT FOR ROLLING STRIP

BACKGROUND OF THE INVENTION

1. Field of the Invention

The present invention relates to a method and an arrangement for rolling strip by means of axially displaceable rolls, particularly by means of wear-resistant rolls.

2. Description of the Related Art

In the field of rolling of strip, several important influencing variables are known which influence the profile and the planeness of the strip. One of these influencing variables is the thermal camber of the rolls which increases with increasing throughput of rolling stock through a roll stand. The thermal camber decreases from the areas located in the middle of the rolling stock toward the edges of the rolling stock. This means that with increasing throughput of the rolling stock, the rolling stock being rolled has excessive thicknesses at the edges.

Another influencing variable is the wear of the rolls which occurs predominantly where the rolled strip comes into contact with the rolls and which causes the diameter of the rolls to decrease.

In order to make it possible to even out the effects of the thermal camber as well as of the wear, it is known, for example, to carry out a cyclic axial displacement of the rolls. The thermal camber can be counteracted by cooling or heating the rolls. However, these measures are not capable of preventing the thermal camber.

Because of the occurrence of the thermal camber and of the wear of the work rolls, the rolling schedule design (width, material thickness) is subject to stringent rules. However, it is desirable to be able to put together the rolling schedules more freely.

If roll materials are used whose wear is negligibly small, at least one of the influencing variables negatively affecting the rolling schedules has been minimized. However, since the wear of the roll basically counteracts the increasing thermal camber, the thermal camber is even more noticeable when rolling with wear-resistant rolls.

SUMMARY OF THE INVENTION

Therefore, it is the primary object of the present invention to provide a method and a arrangement of the above-described type in which the harmful thermal camber effect is counteracted in a simple and inexpensive manner, so that rolling schedules can be designed more freely.

In accordance with the present invention, rolls with increased diameter end portions are used. The rolls are axially displaced relative to each other in such a way that the rolled strip is in contact over the width thereof with the portions of the rolls having the smaller diameter. With increasing temperature of the rolls and, thus, thermal cambering of the rolls, the rolls are displaced in opposite direction relative to each other until areas of the increased diameter end portions are moved over edge areas of the rolled strip.

The present invention makes it possible to eliminate excessive thicknesses of the strip at the edges of the strip which would otherwise be caused by the increasing thermal camber.

The extent of the displacement of the rolls can be determined, for example, in a computer which determines the thermal camber online with the aid of a computer model, wherein values concerning the contour of the rolls, the elastic deformation of the rolls etc. are utilized for adjusting an optimum displacement position and, thus, a desired strip contour.

The arrangement according to the present invention includes a pair of rolls whose roll bodies have in the end portions thereof a greater diameter as compared to the middle portions of the roll bodies.

In accordance with an advantageous feature of the present invention, the diameter of each roll increases steadily from the middle portion of the roll with the smallest diameter toward the end portions thereof.

In accordance with another feature of the present invention, the diameters of the end portions of each roll are different and the end portion of one roll having the greater diameter is arranged opposite the end portion of the other roll having the smaller diameter.

Another advantageous feature of the present invention provides that only one of the ends of the roll body of each roll has an increased diameter. The rolls are arranged in a mirrorinverted manner, so that the increased diameter end portion of one roll faces the operator side of the stand and the increased diameter end portion of the other roll faces the drive side of the stand.

In accordance with another feature, the maximum difference of the diameters of the middle portion and the increased diameter end portions of each roll is in the order of magnitude of the diameter increase in the form of thermal camber to be expected during operation.

Another feature provides that the difference of the diameters of the middle portion and the increased diameter end portions of each roll is greater than the maximum diameter increase resulting from thermal camber.

The rolls with the increased end portions may be the work rolls of a roll stand.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
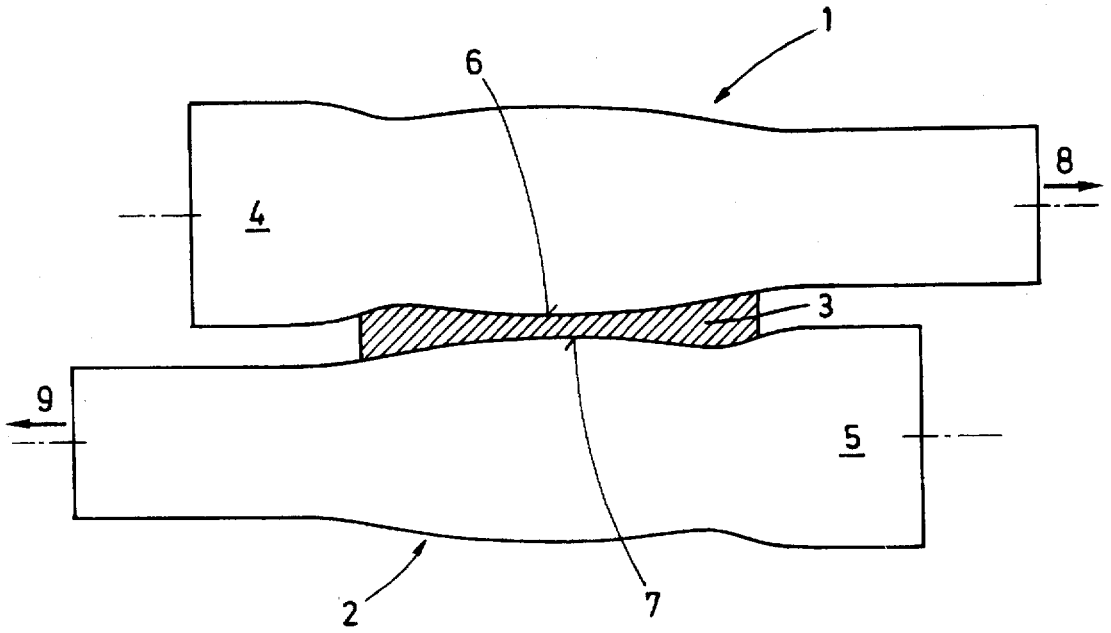
FIG. 1 is a schematic side view of a pair of work rolls according to the present invention shown during the rolling process.

The Figures of the drawing show the increased diameter portions of the rolls in an exaggerated manner for clarity's sake. The thermal camber of the rolls can be seen in the drawing as well as the shape of the rolls according to the present invention. However, the flattening of the rolls which usually occurs during the rolling process and bending of the rolls are not taken into consideration.

FIG. 1 of the drawing shows an upper work roll 1 and a lower work roll 2. The rolled strip 3 is arranged between the work rolls 1 and 2.

The upper work roll 1 has at the left end portion of the roll body thereof a diameter which is the same as the diameter of the right end portion of the roll body of the lower work roll 2. The two work rolls 1, 2 have at their other ends 4, 5 slightly greater diameters.

The thermal camber 6, 7 of the rolls 1, 2 can be seen in the areas of the work rolls 1, 2 which are in contact with the strip 3. The work rolls 1, 2 are axially displaced relative to each other in the direction of the arrows 8, 9, so that the end potions 4, 5 having the greater diameter are moved over the edge areas of the rolled strip.

As can be seen in FIG. 1, the strip 3 has at its edges a thickness which is smaller than would have to be expected if the end portions of the roll bodies of the rolls would not have the increased diameters.

The inclination in axial direction of the transitions from the smaller diameter to the greater diameter of the rolls and the difference between the smaller diameter and the greater diameter depends on the thermal camber 6, 7 to be expected.

Figure 2:
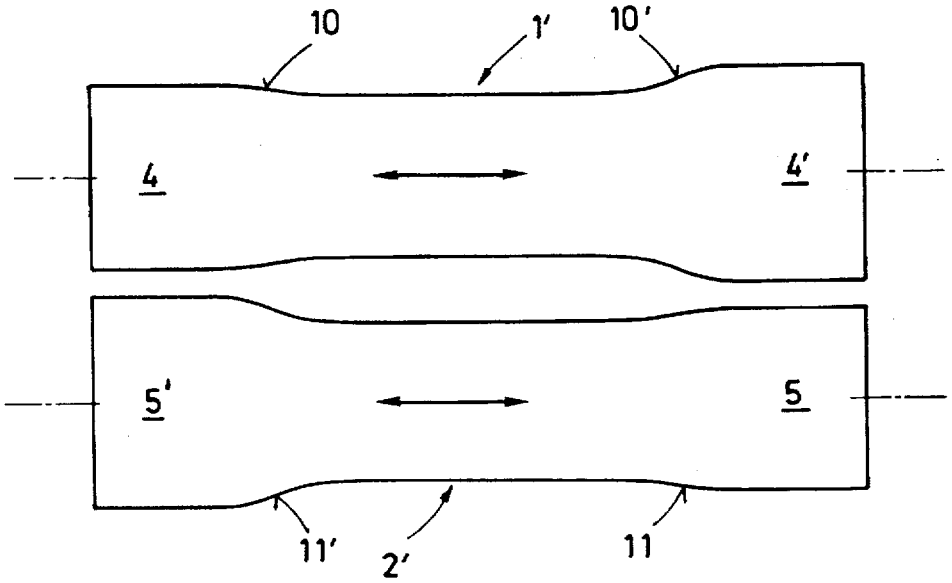
FIG. 2 is a schematic side view of a pair of work rolls with increased diameter end portions at both ends of the rolls.

FIG. 2 of the drawing shows an upper work roll 1' as well as a lower work roll 2', wherein the end portions 4, 4' and 5, 5' of the roll bodies of the rolls have different diameters. The inclinations 10, 10', 11, 11' are also different, so that it is possible to compensate for different thermal cambers.

The invention is not limited by the embodiments described above which are presented as examples only but can be modified in various ways within the scope of protection defined by the appended patent claims.

I claim:

1. A method of rolling strip by means of axially displaceable rolls of wear-resistant material, wherein each roll has a middle portion and increased diameter end portions having an essentially constant diameter connected to the end portions, said middle portion being substantiallly greater than at least one of said increased diameter end portions, the method comprising displacing the rolls relative to each other, so that the strip is over its width in contact with the middle portions of the rolls and, with increasing temperature and thermal camber of the rolls, displacing the rolls relative to each other in opposite directions until areas of the increased diameter end portions are moved over edge areas of the strip.

2. An arrangement for rolling strip, the arrangement comprising a pair of axially displaceable rolls of a wear-resistant material, each roll having a middle portion having a diameter and end portions having an essentially constant diameter connected to the middle portion, wherein the diameter of the at least one end portion of each roll is greater than the diameter of the middle portion.

3. The arrangement according to claim 2, wherein the diameter of each roll increases from the middle portion of the roll toward the at least one end portion with the greater diameter.

4. The arrangement according to claim 2, wherein both end portions of each roll have diameters which are greater than the diameter of the middle portion, wherein one end portion of each roll has a diameter which is greater than the diameter of the other end portion of the roll, and wherein the end portion having the greater diameter of one roll is arranged opposite the end portion of the other roll having the smaller diameter.

5. The arrangement according to claim 2, wherein the rolls are mounted in a roll stand having an operator side and drive side, each roll having one end portion with a diameter greater than the diameter of the middle portion, and wherein the end portion having the greater diameter of one roll faces the operator side and the end portion with the greater diameter of the other roll faces the drive side.

6. An arrangement according to claim 2, wherein a maximum difference of the diameter of each roll in the middle portion and in the at least one end portion is essentially equal to a diameter increase resulting from thermal camber of each roll.

7. An arrangement according to claim 2, wherein a difference of the diameter of the middle portion and the diameter of the at least one end portion is greater than a maximum diameter increase resulting from thermal camber.

8. An arrangement according to claim 2, wherein the rolls are work rolls of a roll stand.

* * * * *